US005214558A

United States Patent [19]

Melnyk

[11] Patent Number: 5,214,558

[45] Date of Patent: May 25, 1993

[54] CHOPPER DRIVE CONTROL CIRCUIT

[75] Inventor: George Melnyk, Endicott, N.Y.

[73] Assignee: International Business Machines Corporation, Armonk, N.Y.

[21] Appl. No.: 782,857

[22] Filed: Oct. 25, 1991

[51] Int. Cl.[5] ..... H01F 7/18

[52] U.S. Cl. ..... 361/154; 323/283; 361/31; 361/195; 361/18; 400/157.2

[58] Field of Search ..... 361/93, 98, 101, 152-154, 361/160, 194, 195-198, 205, 31, 18; 323/282, 284, 901, 908, 283; 318/431, 445; 363/49; 400/157.2, 157.3; 101/93.29

[56] References Cited

U.S. PATENT DOCUMENTS

| | | | |
|---|---|---|---|
| 4,019,100 | 4/1977 | Barrus | 361/186 |
| 4,293,888 | 10/1981 | McCarty | 361/152 |
| 4,297,742 | 10/1981 | Heitzman et al. | 361/154 |
| 4,314,305 | 2/1982 | Williams et al. | 361/154 |
| 4,381,532 | 4/1983 | Arnold | 361/154 |
| 4,408,129 | 10/1983 | Arnold | 307/270 |
| 4,503,480 | 3/1985 | Pickard et al. | 361/152 |
| 4,556,926 | 12/1985 | Yanagida | 361/154 |
| 4,589,401 | 5/1986 | Karim et al. | 123/479 |
| 4,605,983 | 8/1986 | Harvey | 361/154 |
| 4,667,117 | 5/1987 | Nebgen et al. | 307/154 |
| 4,812,945 | 3/1989 | D'Onorio | 361/154 |
| 4,814,937 | 3/1989 | Uota | 361/154 |
| 4,949,215 | 8/1990 | Studtmann et al. | 361/154 |

OTHER PUBLICATIONS

IBM Technical Disclosure Bulletin vol. 20, No. 9, Feb. 1978 "Print Hammer Magnet Control", pp. 3648, 3650 (page 3649 missing).

IBM Technical Disclosure Bulletin vol. 22, No. 5 Oct. 1979 "Impact Force Compensation for Voltage Variations in the Hammer Firiing Pulse in Impact Printer" pp. 1756-1758.

IBM Technical Disclosure Bulletin vol. 24, No. 11B, Apr. 1982 "Printer Hammer Coil Firing Control" pp. 6105-6106.

*Primary Examiner*—A. D. Pellinen
*Assistant Examiner*—David Osborn
*Attorney, Agent, or Firm*—John S. Gasper; Michael E. Belk

[57] ABSTRACT

A coil is connected to a voltage source by a switch enabled by a drive signal of fixed duration. Drive current in a coil is terminated by a chopper circuit if it reaches a predetermined peak level before the end of preselected rise time interval. The chopper circuit is inhibited from operation until the end of the rise time interval during which time the drive current is allowed to decay. The chopper circuit is enabled at the end of the rise time interval for chopping the drive current at an average peak current value for the duration of the preselected time. The total amount of energy supplied to the actuator is adjusted by allowing the current to decay if the peak current is reached before the end of the predetermined rise time interval and then by chopping the current at a predetermined switching rate for the duration of the preselected time of the drive signal. Short circuit protection is also provided during the predetermined rise time interval.

15 Claims, 1 Drawing Sheet

CHOPPER DRIVE CONTROL CIRCUIT

FIELD OF THE INVENTION

This invention relates in general to electromagnet drive circuits and particularly to drive circuits of the type used for operating electromagnetic actuator devices used to operate print hammers in impact printers. While not necessarily limited thereto, the invention has particular use in high speed impact printers.

BACKGROUND OF THE INVENTION

High speed impact printers, as well as other devices, utilize electromagnetic actuators which impel an impact element, commonly called a hammer, against moving type to produce printing. The impact element can be either a ballistic or driven member. The actuators are electromagnets comprising a coil energized by an electric driver circuit which controls the application of current from a DC power source to the coil. High performance impact printers require tight control of the energy imparted to the hammers to obtain good print quality. Variations in energy, resulting from variations in the voltage of the power source or by temperature induced changes in the resistive properties of the coil, affect flight time and impact force level causing undesirable variations in the appearance of the resultant printing.

One approach to solving the problem is to regulate the power source to maintain a constant voltage. However, regulated power supplies may be more costly than desired. Also this would not correct for coil temperature effects. Another approach uses chopper type drivers which can provide good control of the steady state current over a large range of power supply voltages but do not precisely control the total energy for a given time period. One type of chopper drive circuit is the shown in U.S. Pat. No. 4,381,532, where the amount of energy is controlled by monitoring the power supply voltage and by chopping the steady state component of the drive current in the coil at a frequency related to the magnitude of the power supply voltage. In U.S. Pat. No. 4,408,129, the circuit chops the current during the rise time portion as well as the steady state portion operative interval. While this circuit controls the energy supplied to the coil during both the rise time and steady state portions of the operative interval, two chopping circuits are used, one of which is dependent on analog components including a tight tolerance capacitor and a precision current source for generating a reference slope.

Other examples of drive circuits with means for controlling the amount of energy supplied to the coil of an electromagnet may be seen in U.S. Pat. Nos. 4,293,888; 4,503,480; 4,667,117 and in the IBM Technical Disclosure Bulletin Vol. 22 No. 5, of October, 1979, pp. 1756–1758 and Vol. 24 No. 11B of April, 1982, pp. 6105–6106. All of these compensate for variations in voltage occurring during the turn on time of the electromagnet by adjusting the turn on period depending on when a predetermined current level is reached. This produces a hammer firing period which is variable which in some cases complicates the timing of other printing operations or is necessarily limited to avoid adverse impact on other timing operations.

SUMMARY OF THE INVENTION

Basically, the invention controls the amount of energy supplied to the coil during a preselected time by controlling the current both during a timed fixed rise time interval and during the remainder of the preselected time. In accordance with the invention, the current is controlled during the timed fixed rise time interval by simply disconnecting the coil from the power source if the current rises to a predetermined level during the timed rise time interval and holding it disconnected while coil current is allowed to decay until the end of the rise time interval. The current is controlled for the remainder of the preselected time simply by cyclically connecting and disconnecting the coil and the power source at a predetermined frequency from the end of the fixed rise time interval until the end of the preselected time. In accordance with the invention, a drive circuit for a coil of an electromagnet comprises switch means for connecting the coil with a voltage supply, timing means which establishes a predetermined time period, hereinafter referred to as the rise time interval, during which the current should rise to a preset peak level, and circuit means which operates the switch means to disconnect the coil and voltage energy source if the current reaches a preset value before the end of the rise time interval and control means which holds the coil disconnected until the end of the time period and then reconnects the coil with the voltage source and recycles the switch means at a predetermined switch rate for the remainder of the operative interval. In the preferred embodiment, the timing means is a counter, the circuit means for disconnecting the coil and voltage supply is a comparator and the means for holding the coil disconnected until the end of the rise time interval is a latch activated by the counter at the end of a preselected count condition thereof. The drive circuit further provides a source of timing pulses which generates pulses at two different pulse rates, one pulse rate being used to time the rise of the current to its peak level and the other to time the decay until the end of the preset fixed rise time interval. In this way, precise timing is obtained with a counter that is not too large.

Thus it will be seen that an improved constant energy drive circuit has been provided which controls the amount of energy supplied to the coil during both the rise time and steady state portions of the drive period which does not require two chopping circuits or expensive analog circuit devices.

The foregoing as well as other features, advantages and objects will be apparent from the following more particular description of the preferred embodiments of the invention as illustrated in the accompanying drawings.

DETAILED DESCRIPTION OF THE INVENTION

Figures 1, 2:
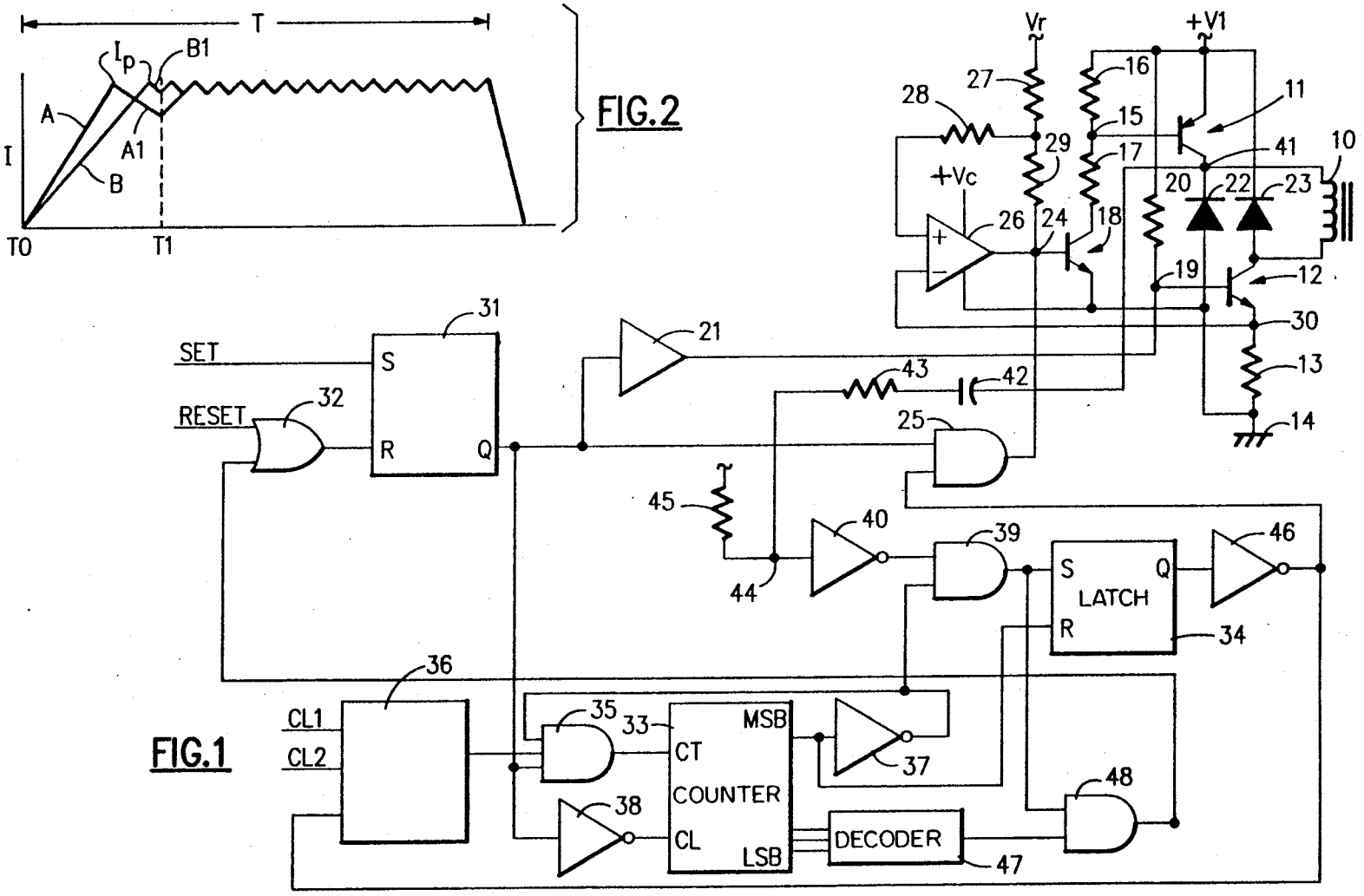
FIG. 1 is a schematic drawing of a drive circuit incorporating the invention.
FIG. 2 is a graph for explaining the operation of the drive circuit of FIG. 1.

As seen in FIG. 1, the drive circuit according to the invention is implemented with coil 10 of an electromagnet, which may be an actuator for a print hammer or the like, connected in series between switch transistors 11 and 12 and sense resistor 13, with the collector of transistor 11 connected to the positive supply voltage +V1 and with sense resistor 13 connected to ground 14. The base of transistor 11 is connected for switching purposes to junction 15 between resistors 16 and 17 in the collector circuit of switch transistor 18 whose emitter is connected to ground 14. Resistor 16 connected to junction 15 and supply voltage +V1 sets the switching voltage level for transistor 11. The base of transistor 12 for switching purposes is connected at junction 19 between resistor 20 and switch 21. Resistor 20 is connected to supply voltage +V1 and sets the switching voltage level for transistor 12. Blocking diodes 22 and 23 protect transistors 11 and 12 from excessive voltage from supply voltage +V1 and coil 10 during switching. The base of switch transistor 18 is connected at junction 24 to the outputs of AND circuit 25 and comparator 26. A voltage divider network comprising resistors 27, 28 and 29 connected as shown to junction 24, the + input of comparator 26 and reference voltage Vr establishes the switch level voltage for transistor 18 as well as the reference voltages for comparator 26. Comparator 26 has a - input connected to junction 30 on the coil side of sense resistor 13. Comparator 26 also has a connection to control voltage +Vc and a connection to ground 14.

The enablement, or closing, of transistors 18 and 12 is accomplished by a SET signal applied to latch 31 which has an output Q connected to switch transistor 21 and one input of AND circuit 25. Transistors 18 and 12 are disenabled or closed by a RESET signal applied through OR circuit 32 connected to the R input of latch 31. The time between the SET and RESET signals is referred to herein as the operative or fire interval. Both SET and RESET signals are supplied by a suitable control unit, such as a microprocessor (not shown) of a print control system, and in accordance with the practice of this invention, the operative interval is preselected and is fixed. During the operative interval established by the SET and RESET signal operation of latch 31, transistor 12 remains closed while transistors 18 and 11 are cyclable by comparator 26 between closed and open conditions and coil 10 and voltage supply source are alternately connected and disconnected at a frequency or rate as predetermined by the parameters of coil 10 and the various resistors described. This cyclic operation produces an alternate rising and decay, commonly called chopping, of the current in coil 10 which results in an average peak or steady state current value in coil 10. At the end of the operative interval, as a result of latch 31 being reset, transistors 18, 11 and 12 are opened thereby disconnecting coil 10 and voltage source +V1 and terminating the energization of the electromagnet.

As is well known, the voltage drop across sense resistor 13, which is a function of the current in resistor 13, is compared with the reference voltage at the + input of comparator 26 and an output produced at junction 24 for cycling switch transistor 18 between closed and open conditions which in turn cycles switch transistor 11 in the same manner. More specifically, when the voltage across sense resistor 13 is below the reference voltage at the + input of comparator 26, as is the case when transistors 18 are enabled by a start or operative signal from latch 31 through AND gate 25 and transistor switch 21, the voltage at junction 24 is raised above ground level and transistors 18 and 12 are closed. The closing of transistor 18 closes transistor 11 thereby connecting coil 10 to voltage supply source +V1 and producing a rising current in coil 10. As the current rises in coil 10 at a rate dependent on the parameters of the coil 10 and sense resistor 13, the voltage drop across sense resistor 13 increases correspondingly. When the voltage drop across sense resistor 13 rises to the level of being equal to the preset reference voltage on the + input of comparator 26, comparator 26 switches junction 24 to ground level, thereby opening transistor 18. This in turn opens transistor 11 and coil 10 is disconnected from voltage supply source +V1 causing current to decay in coil 10. The voltage drop at junction 24 to ground level also causes a lower reference voltage to appear at the + input of comparator 26. The current flow path during decay is from ground 14 through sense resistor 13 to coil 10 through blocking diode 22 to ground 14. The decay current in sense resistor 13 produces a voltage drop at the—input of comparator 26 which, when it matches the lower reference voltage at the + input, produces an output at junction 24 which closes switch transistor 18 resulting in the closing of switch transistor 11 to again connect coil 10 to voltage supply +V causing current in coil 10 to rise toward the preselected peak level. In this manner, comparator 26 cycles the switch transistors 18 and 11 and chops the current in coil at an average peak current.

The above describes the operation of the chopping circuit under ideal rise time conditions, i.e. after the current in coil 10 rises to a preselected peak current level at the predetermined nominal rate to thereby provide a predetermined amount of energy during the fixed rise time interval. In accordance with the invention, however, means is provided which prevents comparator 26 from reclosing and cycling transistors 18 and 11 if the current in coil 10 rises to a preselected peak level before the end of a predetermined fixed rise time interval. In that case, coil 10 is disconnected from the voltage supply source and energy stored therein is dissipated, at a rate based on the parameters of the coil and control circuitry, for remainder of the fixed rise time interval. At the end of the rise time interval, switch transistors 18 and 11 are reenabled to closed positions and comparator 26 resumes operation to cycle switch transistors 18 and 11 as previously discussed for the remainder of the operative interval at the predetermined switching rate established by the parameters of the chopping circuit. In this way, the drive circuit prevents the total amount of energy being supplied to coil 10 from varying notwithstanding fluctuations in supply voltage and resistance of coil 10.

The means for controlling the amount of energy supplied to coil 10 during the rise time interval, according to the invention, includes digital counter 33 and control latch 34. Counter 33 establishes the desired rise time interval. The length of the rise time interval can vary depending on voltage of source +V1 and the inductance and resistance of coil 10 and resistor 13 and usually can be a relatively small fraction of the operative interval established by the SET and RESET signals applied to latch 31. Control latch 34 prevents comparator 26 from reclosing switch transistor 18 until counter 33 has timed out. Counter 33 has a first input CT connected through AND circuit 35 which has one input connected to clock selector circuitry 36 for receiving clock pulses from a timing source. The timing source may be of any type producing digital pulses of a selected frequency for timing a rise time interval of relatively short duration. Preferably, in accordance with another feature of this invention, the timing source supplies two timing pulses CL1 and CL2 where CL2 is a submultiple of CL1. With this arrangement, an extended rise time interval is achievable without the need for increasing the size of counter 33. An extended rise time interval would be desirable where the decay portion needs to be prolonged such as where the electromagnet is driven deep into saturation and the amount of energy to be extracted needs to be greater than where the electromagnet is not or is only slightly saturated. A second timing source may not be needed if the electromagnet is not driven into saturation. A second input to AND circuit 35 is connected to the output Q of latch 31. A third input to AND circuit 35 is a feedback loop from inverter 37 connected to a predetermined high count output of counter 33. Counter 33 has a clear input CL connected through inverter circuit 38 to the output Q of latch 31. Counter 33 is cleared by latch 31 being operated by a RESET signal.

Control latch 34 has a set input S connected through AND circuit 39 which has a first input to the inverter 37 in the feedback circuit arrangement of counter 33. A second input to AND circuit 39 is from inverter circuit 40 which has an input connection with coil 10 at junction 41 through capacitor 42 and resistor 43 to a junction 44 with resistor 45 which is connected to a control voltage +Vc. Control latch 34 has a reset input R connected to the output of counter 33. The output of control latch 34 is connected through inverter circuit 46 to AND circuit 25 and to clock selector circuitry 36. When reset, control latch 34 has the Q output that is negative and inverter 46 conditions AND circuit 25 to gate a positive output signal from operate latch 31 to junction 24 to turn on transistor 18 as previously described. When reset, control latch 34 also conditions clock selector circuitry 36 to apply CL1 clock pulses, i.e. the higher frequency timing pulses to AND circuit 35. When set, the Q output of control latch 34 is positive and the output of inverter 46 is negative thereby blocking any positive output signal from latch 31 to junction 24 and thereby opening switch transistor 18. When set, control latch 34 also conditions clock selector circuitry 36 to apply CL2 clock pulses, i.e. the lower frequency pulses to AND circuit 35.

When control latch 34 is set the first time coil 10 is disconnected from +V1 by the opening of switch transistors 18 and 11 by comparator 26 in response to a preselected peak current level in coil 10. Control latch 34 is set by inverter 40 switching positive for a short interval in response to a negative going impulse of short duration generated at junction 41 by coil 10 through capacitor 42 and resistor 43 to junction and if counter 33 is at a count condition less than the preselected count which establishes the rise time interval. The duration of the impulse is a function of the RC circuit formed by capacitor 42 and resistors 43 and 45. Control latch 34 remains set until reset by a positive output signal from counter 33 when it reaches its preselected (i.e. MSB) count level. Counter 33 having reached its preselected count, inverter 37 goes negative so that timing pulses from clock selector 36 are blocked at AND circuit from reaching counter 33 and AND circuit 39 is conditioned to block subsequent feedback pulses from coil 10, produced during cycling operations of transistors 18 and 11, from setting control latch 34 for the remainder of the operative interval. Upon resetting of control latch 34 by counter 33 having reached its predetermined (MSB) count level, inverter 46 reconditions AND circuit 25 to gate the positive Q output from latch 31 to junction 24 to thereby close transistors 18 and 11 and to reinitiate the cycling operation by comparator 26 for the remainder of the operative interval. Inverter 46 also reconditions clock selector circuitry 36 to apply CL1 clock pulses to AND circuit 35 for gating to counter 33 after counter 33 is cleared in response to a RESET signal to latch 31 and a SET signal is applied to latch 31 at the beginning of the next operative interval.

In addition to establishing and timing the predetermined rise time portion of the operative interval, counter 33 provides a window during which the current should rise and which can be used to turn off the drive circuitry in the case of shorts either in coil 10 or some other part of the drive circuit. If coil 10 is shorted, current in coil 10 will rise to the predetermined peak level in a very short time. For that reason, counter 33 is provided with a low (LSB) count output connected to a too early decode circuit 47 which in turn is connected via AND circuit 48 through OR circuit 32 to the reset input R of fire latch 31. In the case of an electrical short, coil 10 is disconnected by comparator 26 at the too early count stage of counter 33 and a disconnect pulse from coil 10 to inverter 40 and the output of inverter 40 is gated through AND circuit 39 by a positive output from inverter 37 and through AND circuit 48 by an output from decode 47 through OR circuit 32 to the R input of latch 31.

Referring to FIGS. 1 and 2, the operation of the drive circuit is as follows:

In its quiescent state latch 31 and control latch 34 are reset and switch transistors 11, 12 and 18 are open and coil 10 and voltage supply +V1 are disconnected. The outputs from latches 31 and 34 being down, inverter 38 resets and holds counter 33 clear, inverter 46 conditions AND circuit 25 and conditions clock selector circuitry 36 to gate CL1 clock pulses to AND circuit 35. Counter 33 being held clear, its output is down whereby inverter circuit 37 conditions AND circuit 39 to gate a positive Q output from latch 31 to junction 24. A low level positive voltage at junction 44 from control voltage +Vc holds inverter circuit 40 down so that control latch 34 is blocked from being set.

At the beginning of operation, a SET signal to latch 31 produces an up output signal which removes the reset from counter 33 and opens AND circuit 35 allowing clock pulses CL1 to advance counter 33. The up output from latch 31 closes switch transistors 18, 11 and 12 as previously described thereby connecting coil 10 to voltage supply +V1 and causing rising current to flow in coil 10 and sense resistor 13 to ground 14 as previously described. If the power supply voltage is high, i.e. above the design level, the current in coil 10 will rise along slope A as shown in FIG. 2. When the current in coil 10 reaches Ip, comparator 26 will turn off switch transistors 18 and 11 and coil 10 will be disconnected from supply voltage +V, as previously described, which results in the current in coil 10 reversing direction and decaying along the slope A1 in FIG. 1. This results in a negative going disconnect pulse of short duration at junction 41 through capacitor 42 and resistor 43 to inverter 40. Inverter 40 produces a positive going pulse of short duration from inverter 40 which is gated through AND circuit 39 and sets control latch 34. Inverter 40 then reverts to its negative output condition to prevent further setting of control latch for the duration of the operative interval. The setting of control latch 34 causes inverter 46 to block the application of the output signal from latch 31 to junction 24 until control latch 34 is reset. Inverter 46 also switches clock selector circuitry 36 so that clock pulses CL2 pass through AND circuit 35 to counter 33.

As seen in FIG. 1, the current in coil 10 continues to decay until completion of time T1 which is the end of the preselected rise time interval fixed by counter 33. Upon reaching its preset count condition, counter 33 generates an output signal which resets control latch 34. The inverted output from inverter circuit 37 blocks further clock pulses from clock selector circuitry 36 through AND circuit 35 to counter 33 and feedback pulses from inverter 39 to control latch 34. Control latch 34 having been reset, its output Q goes negative causing inverter 46 to condition AND circuit 25 for the reapplication of the positive output of fire latch 31 to junction 24 which closes transistor 18 and 11 which reconnects coil 10 with voltage supply +V1. For the remainder of the operative interval, that is from T1 to the end of time T, transistors 18 and 11 are cycled by comparator 26 at a predetermined switching frequency to thereby chop the current in coil 10 at an average peak current value which fixes the amount of energy supplied to coil 10 during the remainder of the operative interval.

Again referring to FIG. 1, if the voltage level drops from the previous high level, or alternatively, the resistance of coil 10 increases due to temperature, current in coil 10 rises at a much lower rate along slope B and reaches Ip at a much later time in the course of the predetermined rise time interval T0 to T1. Less energy is being supplied to coil 10 as a result of the slower rate of current rise. Coil 10 is disconnected by comparator 26 from +V1 much later in the count cycle of counter 33. Control latch 34 is also reset by counter 33 a much shorter time after the comparator 26 disconnects coil 10 and +V1. Thus the amount of time during which current in coil 10 is allowed to decay, as shown by line B1, is also much shorter and the amount of energy removed from the coil is proportionately smaller. Thus as the voltage fluctuates, the counter 33 and control latch 34 coact to allow variable amounts of energy to be removed from the system so as to maintain the amount of energy supplied to coil 10 at a predetermined amount during the predetermined fixed rise time interval. Thereafter, the amount of energy supplied to coil 10 is controlled by the chopping circuit of comparator 26. Changes in the resistance of coil 10 during periods of extensive use can also have an effect in varying the rate of increase of current during the predetermined rise time interval. Due to action of counter 33 and control latch 34, the current in coil 10 is adjusted under those conditions.

A specific drive circuit contained circuit elements having the following parameters:

1. Resistors:
13 - r = .5 ohms
16 - r = 200 ohms
17 - r = 2k ohms
20 - r = 5.6k ohms
27 - r = 3k ohms
28 - r = 10k ohms
29 - r = 680 ohms
43 - r = 33k ohms
45 - r = 45k ohms
2. Coil 10; R = 6 ohms, L = 1 MH
3. Capacitor 42; C = 250 pf
4. Transistors
11 - PNP Motorola 2N6041
12 - NPN Motorola 2N6044

-continued

18 - NPN Motorola 2N720A
5. Voltages
+V1 - +60V
+Vr - +6V
+Vc - +5V
6. Logic Elements
Comparator 26 - LM 339
Fire Latch 31 - 7474
Control Latch 33 - 7474
Counter 33 - 74393
Switch 21 - 7407
Inverters 37, 38, 40, 46 - 7404

The logic element part numbers are all standard part numbers available from various circuit component manufacturers.

Using the above circuit elements, a drive circuit was obtained in which a flight time variation of 5 usec was measured over a voltage range of 54–66 v whereas a hammer flight time variation of 50 usec was measured without the rise time compensation as described.

Thus it will be seen that a drive circuit has been provided which controls the amount of energy supplied to the drive coil both during the rise time portion and during the remainder of an operative interval of fixed duration. It is also seen that constant energy control is obtained during both the rise time and steady state portions of a fixed operative interval with only a single chopping circuit. By using a counter and control latch, a more simple circuit is provided which eliminates the need for special analog devices and a precision current source and which is easily integrated in solid state circuitry.

While the novel features of the invention have been shown and described with reference to a preferred embodiment thereof, it will be understood by those skilled in the art, that changes can be made in the form and details without departing from the spirit and scope of the invention as set forth in the appended claims.

What is claimed is:

1. A drive circuit for an electromagnet having a coil connectable with a voltage source by a chopping circuit means including a switch means between the coil and the source, said chopping circuit means enabled by a drive signal for disconnecting said coil and said voltage source in response to a predetermined level of current in said coil, said drive circuit being characterized by the inclusion of timing means operable in response to said drive signal for measuring a preset time during which current in said coil should rise to said predetermined level after said switch means is enabled by said drive signal, and control means operable to disable said chopping circuit means between the time the chopping circuit means disconnects the coil due to the predetermined level of current in the coil being reached and said preset time, said control means, when said preset time is reached, enabling the chopping circuit means to alternately connect and disconnect said coil and voltage source at a predetermined frequency until the end of said drive signal.

2. A drive circuit in accordance with claim 1 wherein said control means is further operable in response to said timing means at the end of said preset time to be non-responsive to disconnection of said coil from said voltage source after said preset time.

3. A drive circuit in accordance with claim 2 wherein said timing source is operable for generating timing pulses having first and second pulse rates, and said counter means is operable for counting said timing pulses at either said first or second pulse rates during said preset time.

4. A drive circuit in accordance with claim 3 wherein said counter means is controllable by said bistable circuit means for counting timing pulses at said first rate until current rises in said coil to said upper peak level and then for counting timing pulses at said second rate until the end of said preset time.

5. A drive circuit in accordance with claim 4 wherein said timing pulses at said second rate are one half the rate of said timing pulses at said first rate.

6. A drive circuit in accordance with claim 3 wherein said control means further includes selector circuit means connecting said timing source and said counter means, and said selector circuit means is operable by said bistable circuit means for gating timing pulses of said first or second rates to said counter.

7. A drive circuit in accordance with claim 1 wherein said timing means comprises counter means operable by said drive signal for counting a preset number of timing pulses from a timing source, and said control means comprises bistable circuit means responsive to said disconnection of said coil and to said timing means for successively delaying and enabling said chopping circuit means.

8. A drive circuit in accordance with claim 1 wherein said timing means comprises a source of timing pulses, counter means for counting a preset number of said timing pulses as a measure of said preset time and circuit means activated by said drive signal for gating timing pulses from said timing source to said counter means, and said control means comprises bistable circuit means having a first state in which it is responsive to said disconnection of said coil during said preset time and a second state in which it is responsive to said timing means at the end of said preset time.

9. A drive circuit in accordance with claim 8 wherein said bistable circuit means comprises a latch circuit having a first input connected for receiving a signal in response to the disconnection of said coil from said voltage source, a second input connected for receiving a signal from said counter means at the end of said preset time and an output connected to said chopping circuit means for supplying output signals for delaying and enabling said chopping circuit means in accordance with signals received at said first and second inputs of said latch circuit.

10. A drive circuit in accordance with claim 9 wherein said first input of said latch circuit is a SET input and said second input is a RESET input.

11. A drive circuit in accordance with claim 1, further including: means for detecting an electrical short in said coil or said drive circuit; and means for disconnecting said coil from said voltage source in response to said detection of an electrical short.

12. A drive circuit in accordance with claim 1 wherein said means for detecting includes means for determining if current in the coil rises to a predetermined level before a predetermined time.

13. A drive circuit in accordance with claim 1 wherein the duration of the drive signal is fixed.

14. A method of controlling a drive circuit for supplying a controlled amount of energy to the coil of a solenoid in a preselected time comprising the steps of connecting said coil to a voltage source, defining a preset time from the beginning of said preselected time during which current in said coil should reach a predetermined peak level, disconnecting said coil from said voltage source if said current in said coil rises to said predetermined peak level during said preset time and allowing said current in said coil to decay until the end of said preset time, and then cyclically connecting and disconnecting said coil and said voltage source at a predetermined rate from the end of said preset time until the end of said preselected time, wherein said preset time and a period of the cycle at said predetermined rate are unequal and unrelated.

15. A drive circuit for an electromagnet having a coil connectable with a voltage source by a chopping circuit means including a switch means between the coil and the source, said chopping circuit means enabled by a drive signal, and to alternately disconnect and connect said coil and said voltage source in response to predetermined upper and lower peak levels of current in said coil, said drive circuit being characterized by the inclusion of timing means operable in response to said drive signal for timing a preset time during which current in said coil should rise to said preset upper peak level after said coil is first connected with said voltage source, and control means operable to disable said chopping circuit means between the time the chopping circuit means disconnects the coil due to the predetermined upper level of current in the coil being reached and said preset time, said control means, when said preset time is reached, enabling the chopping circuit means to alternately connect and disconnect said coil and voltage source at said predetermined frequency until the end of said drive signal.

* * * * *